US006448935B2

(12) United States Patent
Fuchs et al.

(10) Patent No.: US 6,448,935 B2
(45) Date of Patent: Sep. 10, 2002

(54) VEHICLE ANTENNA

(75) Inventors: Andreas Fuchs, Lake Orion, MI (US); Ralf Duersch, Goflar (DE); Charles S. Voeltzel, New Kensington, PA (US)

(73) Assignee: PPG Industries Ohio, Inc., Cleveland, OH (US)

( * ) Notice: Subject to any disclaimer, the term of this patent is extended or adjusted under 35 U.S.C. 154(b) by 0 days.

(21) Appl. No.: 09/780,888

(22) Filed: Feb. 9, 2001

Related U.S. Application Data

(60) Provisional application No. 60/181,775, filed on Feb. 11, 2000.

(51) Int. Cl.[7] ..... H01Q 1/32
(52) U.S. Cl. ..... 343/713; 343/704
(58) Field of Search ..... 343/704, 711, 343/712, 713; H01Q 1/32

(56) References Cited

U.S. PATENT DOCUMENTS

| | | | | |
|---|---|---|---|---|
| 3,655,545 A | | 4/1972 | Gillery et al. | 204/192 |
| 3,962,488 A | | 6/1976 | Gillery | 427/109 |
| 4,260,989 A | * | 4/1981 | Ishii et al. | 343/704 |
| 4,491,844 A | * | 1/1985 | Tsuchie et al. | 343/713 |
| 4,707,700 A | | 11/1987 | Nagy | 343/712 |
| 4,746,347 A | | 5/1988 | Sensi | 65/94 |
| 4,768,037 A | | 8/1988 | Inaba et al. | 343/713 |
| 4,791,426 A | | 12/1988 | Lindenmeier et al. | 343/713 |
| 4,792,536 A | | 12/1988 | Pecoraro et al. | 501/70 |
| 4,820,902 A | | 4/1989 | Gillery | 219/203 |
| 4,849,766 A | | 7/1989 | Inaba et al. | 343/713 |
| 4,864,316 A | | 9/1989 | Kaoru et al. | 343/704 |
| 4,898,789 A | | 2/1990 | Finley | 428/623 |
| 5,017,933 A | | 5/1991 | Sakurai et al. | 343/704 |
| 5,028,759 A | | 7/1991 | Finley | 219/203 |
| 5,083,135 A | | 1/1992 | Nagy et al. | 343/713 |
| 5,239,302 A | * | 8/1993 | Maeda et al. | 343/704 |
| 5,240,886 A | | 8/1993 | Gulotta et al. | 501/70 |
| 5,355,144 A | | 10/1994 | Walton et al. | 343/713 |
| 5,385,872 A | | 1/1995 | Gulotta et al. | 501/71 |
| 5,393,593 A | | 2/1995 | Gulotta et al. | 428/220 |
| 5,528,314 A | | 6/1996 | Nagy et al. | 348/713 |
| 5,653,903 A | | 8/1997 | Pinchok, Jr. et al. | 219/203 |
| 5,670,966 A | | 9/1997 | Dishart et al. | 343/713 |
| 5,796,055 A | | 8/1998 | Benson, Jr. et al. | 181/208 |
| 5,902,505 A | | 5/1999 | Finley | 219/547 |
| 5,905,469 A | | 5/1999 | Lindenmeier et al. | 343/713 |
| 5,959,587 A | | 9/1999 | McHenry et al. | 343/713 |
| 6,064,345 A | * | 5/2000 | Ohnishi et al. | 343/713 |

FOREIGN PATENT DOCUMENTS

| | | |
|---|---|---|
| EP | 0 847 100 | 6/1998 |
| GB | 2019100 | 10/1979 |

* cited by examiner

*Primary Examiner*—Tho Phan
(74) *Attorney, Agent, or Firm*—Kenneth J. Stachel

(57) ABSTRACT

An antenna includes a support and an electroconductive first antenna element, e.g., an electroconductive coating, located on the support and spaced from at least one electroconductive second antenna element. The first antenna element is connected to a ground through an electronic filter device, such as an inductor, configured to pass selected frequencies, e.g., AM frequencies, to the ground to eliminate the selected frequencies from the signal provided by the first antenna element. The first antenna element is preferably located between the second antenna element and a source of electronic noise to shield the second antenna element from at least a portion of the electronic noise. The second antenna element receives and provides at least one of the selected frequencies passed to the ground from the first antenna element.

31 Claims, 2 Drawing Sheets

VEHICLE ANTENNA

CROSS-REFERENCE TO RELATED APPLICATION

This application claims the benefits of U.S. Provisional Application No. 60/181,775 entitled "Vehicle Antenna" filed Feb. 11, 2000, which is herein incorporated by reference in its entirety.

BACKGROUND OF THE INVENTION

1. Field of the Invention

The present invention relates generally to radiowave receiving vehicle antennas and, more particularly, to vehicle antennas having electroconductive coating regions provided on selected portions of a vehicle transparency.

2. Technical Considerations

In the past, traditional motor vehicle antennas for receiving and transmitting radiowave signals included whip-type antennas and embedded or printed wire antennas in rear window defoggers and windshields. More recently, it has been found that various electroconductive coating patterns may be combined to produce an antenna for a vehicle. For example, U.S. Pat. No. 5,670,966 to Dishart et al. discloses an automotive antenna having several electrically interconnected coating regions. U.S. Pat. No. 5,355,144 to Walton et al. discloses a slot antenna in combination with a vehicle window. U.S. Pat. Nos. 5,083,135 and 5,528,314 to Nagy et al. disclose a vehicle antenna having a transparent coating in the shape of a "T". U.S. Pat. No. 4,791,426 discloses a vehicle antenna system mounted on an electrically heated rear window. The antenna system is formed by an antenna element and a set of heating elements. Other exemplary vehicle antennas are disclosed in U.S. Pat. Nos. 4,707,700; 4,768,037; 4,849,766; 4,791,426; 5,905,469; 4,864,316; and 5,017,933, just to name a few. In these known antenna systems, a connector arrangement generally conducts the radio wave signal received by the antenna to a receiver, e.g. a radio.

These known vehicle antennas generally function adequately. However, when such antennas are incorporated into the windshield of a vehicle, relatively low power, low frequency electronic "noise", e.g., from the dashboard and/or engine compartment of the vehicle, can interfere with the reception at lower frequencies, such as in the range of 150 kHz to 1710 kHz (i.e., AM frequencies). Sources of such noise include the vehicle ignition system, engine blower motor, fan motors, windshield wipers, power sideview mirrors, and headlights. This electronic noise can reduce the quality of the radio signal received by the receiver.

Therefore, it would be advantageous to provide an antenna, particularly an automotive antenna, utilizing one or more electroconductive coatings but with improved reception characteristics, e.g., having lower noise susceptibility than known antennas.

SUMMARY OF THE INVENTION

In accordance with the present invention, there is provided an antenna comprising a support and at least one electroconductive first antenna element, e.g., at least one electroconductive first coating region, located on the support and spaced apart from at least one electroconductive second antenna element, e.g., at least one electroconductive second coating region. The first antenna element is connected to at least one electronic filter device, such as a low-pass filter, band-pass filter, or inductor, configured to pass one or more selected frequencies, e.g., one or more frequencies in the range of 150 kHz to 1710 kHz, to an electronic ground to eliminate the selected frequencies from the signal provided by the first antenna element.

In one exemplary embodiment, the antenna is part of a laminated vehicle transparency, with the first antenna element located closer to the source of noise than the second antenna element. The source of noise can be, for instance, around or under the vehicle dashboard from one or more motors. The first antenna element acts as an electronic shield to shield the second antenna element from the vehicle electronic noise. The first antenna element can be connected to at least one electronic filter to filter out one or more frequencies most susceptible to interference by the vehicle noise. The second antenna element, located remotely from the source of the noise with the first antenna element located between the noise source and the second antenna element, is designed to provide a signal which includes at least the one or more selected frequencies filtered from the signal provided by the first antenna element. For instance, the laminated transparency can be a windshield where the first antenna element is located below, i.e., closer to the dashboard, than the second antenna element. In addition to acting as an antenna, one or more of the antenna elements, e.g., the first antenna element, may also be electrically connected to a power source, such as the vehicle battery, so that the first coating region also functions as a heating element.

A method of making an antenna in accordance with the invention comprises providing at least one electroconductive first coating region on a support, providing at least one electro-conductive second coating region on the support and spaced from the first coating region, and electrically connecting the first coating region to a ground through at least one electronic filter device, such as a low-pass filter, band-pass filter, or inductor. The electronic filter device is configured to pass one or more selected frequencies, e.g., one or more frequencies in the range of 150 kHz to 1710 kHz, from the signal provided by the first coating region to the ground. The signals from the first and second coating regions can be directed to at least one receiver, such as a radio.

DESCRIPTION OF THE PREFERRED EMBODIMENTS

Figure 1:
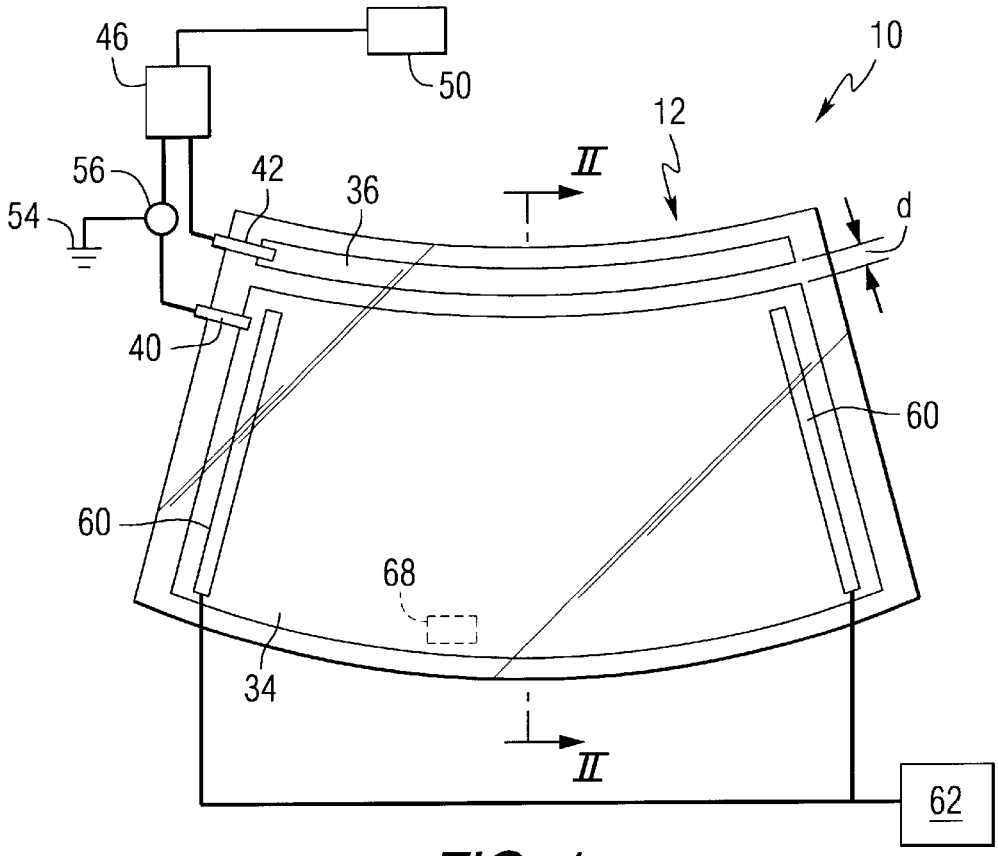
FIG. 1 is a plan view (not to scale) of a vehicle transparency having an antenna incorporating features of the present invention.

As used herein, spatial or directional terms, such as "left", "right", "inner", "outer", "above", "below", "top", "bottom", and the like, relate to the invention as it is shown in the drawing figures. However, it is to be understood that the invention may assume various alternative orientations and, accordingly, such terms are not to be considered as limiting. Further, all numbers expressing dimensions, physical characteristics, processing parameters, quantities of ingredients, reaction conditions, and the like used in the specification and claims are to be understood as being modified in all instances by the term "about". Accordingly, unless indicated to the contrary, the numerical values set forth in the following specification and claims are approximations that may vary depending upon the desired properties sought to be obtained by the present invention. At the very least, and not as an attempt to limit the application of the doctrine of equivalents to the scope of the claims, each numerical value should at least be construed in light of the number of reported significant digits and by applying ordinary rounding techniques. Moreover, all ranges disclosed herein are to be understood to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more and ending with a maximum value of 10 or less, e.g., 5.5 to 10. Further, as used herein, the terms "deposited over" or "provided over" mean deposited or provided on but not necessarily in surface contact with. For example, a coating "deposited over" a substrate does not preclude the presence of one or more other coating films of the same or different composition located between the deposited coating and the substrate.

For purposes of the following discussion, the invention will be discussed with reference to use with a vehicle transparency. As used herein, the term "vehicle transparency" refers generally to vehicle sidelights, rear lights, windshields, moon roofs, sunroofs, and the like. However, it is to be understood that the invention is not limited to use with vehicle transparencies but could be practiced in any desired field, such as laminated or non-laminated residential or commercial windows. Additionally, although the invention will be described with reference to filtering noise frequencies in the conventional AM frequency range, it is to be understood that the invention could be practiced with regard to filtering noise of any desired frequency.

Figure 2:
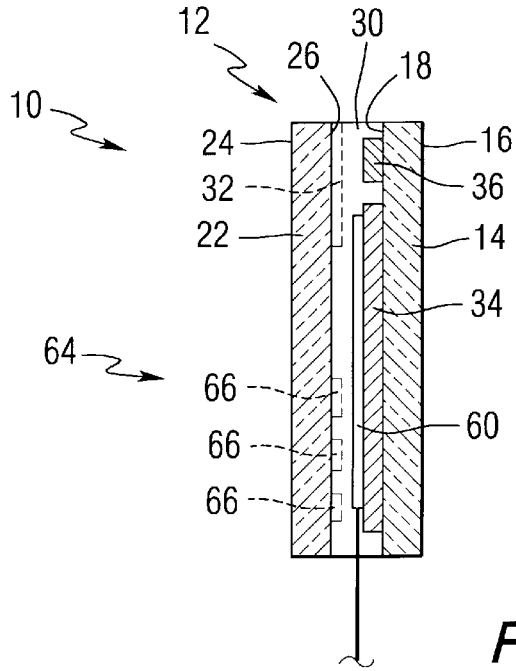
FIG. 2 is a section taken along the line II—II in FIG. 1.

FIGS. 1 and 2 illustrate a support in the form of a vehicle transparency 10 having an antenna 12 incorporating features of the present invention. For purposes of the following discussion, the transparency 10 will be discussed a laminated vehicle windshield formed in any conventional manner. Exemplary vehicle windshields and methods of making the same are found in U.S. Pat. Nos. 4,820,902; 5,028,759; and 5,653,903, herein incorporated by reference.

The transparency 10 includes a first ply 14 having an outer major surface 16 (conventionally referred to as the number 4 surface) and an inner major surface 18 (conventionally referred to as the number 3 surface). The transparency 10 further includes a second ply 22 having an outer major surface 24 (number 1 surface) and an inner major surface 26 (number 2 surface), with the first and second plies 14 and 22 held together by an interlayer 30.

Usually, the outer major surface 24 faces the exterior of the vehicle and the outer major surface 16 faces the interior of the vehicle. As shown in FIG. 2, a decorative shade band 32, e.g., an opaque, translucent or colored band, such as a ceramic band, may be provided on a surface of at least one of the plies 14, 22, for example around the perimeter of the inner major surface 26, in any conventional manner.

The first and second plies 14, 22 can have any desired degree of transparency or any desired optical characteristics. For automotive use, the first and second plies 14, 22 are each preferably made of a transparent or translucent material, such as plastic (e.g., polymethylmethacrylate, polycarbonate, polyurethane, polyethyleneterephthalate (PET), or copolymers of any monomers for preparing these, or mixtures thereof), ceramic or, more preferably, glass. The glass may be of any type, such as conventional float glass or flat glass, and may be of any composition having any optical properties, e.g., any value of visible transmission, ultraviolet transmission, infrared transmission, and/or total solar energy transmission. The glass can be, for example, conventional untinted soda lime silicate glass, i.e. "clear glass", or can be tinted or otherwise colored glass, borosilicate glass, leaded glass, tempered, untempered, annealed, heat treated or heat strengthened glass. As used herein, the term "heat treated" means annealed, tempered, or at least partially tempered. The first and second plies 14, 22 can each be "clear" float glass or can be tinted or colored glass or float glass or one ply can be clear glass and the other colored glass. Although not limiting to the invention, examples of glass suitable for the first ply 14 and/or second ply 22 are described in U.S. Pat. Nos. 4,746,347; 4,792,536; 5,240,886; 5,385,872; and 5,393,593, which are herein incorporated by reference. For use in automotive transparencies, the first and second plies 14, 22 are each preferably less than 10 mm thick, e.g., 1 mm to 5 mm thick, such as 3.2 mm thick.

The interlayer 30 is preferably a plastic material, such as polyvinyl butyral or a similar material, having a thickness of between 0.5 mm to 1 mm, such as 0.76 mm. The interlayer 30 secures the plies 16 and 22 together, provides energy absorption, reduces sound attenuation into the interior of the vehicle to decrease road noise and increases the strength of the laminated structure. The interlayer 30 may be a sound absorbing or attenuating material as described, for example, in U.S. Pat. No. 5,796,055.

In the embodiment shown in FIGS. 1 and 2, the antenna 12 includes a first antenna element 34 spaced apart from a second antenna element 36 by a distance "d" of 10 mm to 50 mm, e.g., 30 mm. The second antenna element 36 extends along an upper portion of the windshield and the first antenna element 34 preferably is positioned below the second element 36 and generally occupies the central portion of the transparency 10, which constitutes a major portion of the vision area of the transparency 10. The first and second antenna elements 34, 36 can be located on any surface of the plies 14, 22. However, in a currently preferred embodiment, the first and second antenna elements 34, 36 are located on an inner surface 18 or 26 of one of the plies 14, 22, e.g., inner surface 18 of the first ply 14. However, it should be appreciated that the antenna elements 34 and 36 may be oriented relative to each other in configurations other than that shown in FIG. 1. For example, the second antenna element 36 may be positioned off-center or between the first antenna element 34 and a side or bottom edge of the windshield. Alternatively, the first and second antenna elements 34, 36 can be located on different surfaces. For example, these antenna elements 34, 36 in a similar position relative to each other can be located on different plies in a laminated transparency.

The first and second antenna elements 34, 36 preferably comprise transparent or substantially transparent, electroconductive coatings deposited over a major surface, e.g., a major inner surface, of one of the glass plies forming the windshield in any manner well known in the art. As used herein, the term "substantially transparent" means having a visible light transmittance (VLT) of greater than 60 percent. Of course, as can be appreciated the VLT of the coating can be less than substantially transparent for coatings on plies such as privacy glass and the like where the VLT is less than 60 percent. As used herein, the terms "coating" or "coating region" can include one or more coating layers and/or coating films of desired or selected coating composition. The coatings may be multi-component coatings, i.e., containing a plurality of layers or regions of different composition, deposited over at least a portion of the substrate surface in any conventional manner, such as but not limited to magnetron sputter vapor deposition (MSVD), chemical vapor deposition (CVD), spray pyrolysis, sol-gel, etc. The coatings forming the coating regions may be single or multiple layer, metal-containing coatings, for example, as disclosed in U.S. Pat. No. 3,655,545 to Gillery et al.; U.S. Pat. No. 3,962,488 to Gillery; U.S. Pat. No. 5,902,505 to Finley; and U.S. Pat. No. 4,898,789 to Finley, which are herein incorporated by reference. An example of suitable commercially available coatings include the SUNGATE® family of coatings, e.g. SUNGATE 1000® coating, commercially available from PPG Industries, Inc. of Pittsburgh, Pa., Since in the particular embodiment of the invention shown in FIGS. 1 and 2 the second antenna element 36 is not in the major vision area of the windshield, the second antenna element 36 may alternatively be a nontransparent electroconductive material, e.g., a silver containing ceramic paint, metal foil, etc. For example, the second antenna element 36 may be located in the shade band area of the windshield such that the second antenna element 36, optionally the second antenna element 36 and the gap between the first and second antenna elements 34, 36, can be obscured or hidden by the shade band 32 when present. It should be appreciated that this applies to any antenna element that does not obstruct the main viewing area of the transparency 10. As a result, it is contemplated that the antenna 12 may include multiple antenna elements positioned outside the central viewing area of the windshield, for example, two or more antenna elements positioned in the upper portion of the windshield. Some of these antenna elements may be nontransparent electroconductive materials as discussed above. It is also contemplated that one or more of the antenna elements may be electroconductive wire mesh or screen members. In a currently preferred practice of the invention, the first antenna element 34 extends over substantially the entire principal vision area of the transparency 10 and covers a larger area on the transparency 10 than the second antenna element 36. The first antenna element 34 may extend close to the edge of the transparency 10. This depends on the electrical connections and sealing elements used for the transparency 10. The upper edge of the first antenna element 34 preferably extends at least partially out of the principal vision area of the transparency 10, e.g. into the shade band area (FIG. 2), which can reduce the visibility of the interface between the bottom of the second antenna element 36 and the top of the first antenna element 34.

With continued reference to FIGS. 1 and 2, the first and second antenna elements 34 and 36 in this particular configuration are basically quadrilateral in shape and preferably spaced from the peripheral edge of the windshield, although it is contemplated that the antenna 12 may have other multi-element configurations. The exact shape and position of each element and the spacing between the antenna elements depends, in part, on the design of the vehicle in which the windshield will be installed, the angle of installation, the coating resistivity, the type of signal to be transmitted or received, and the desired performance of the antenna. These types of design considerations for a transparent glass antenna are discussed in U.S. Pat. Nos. 4,768,037; 4,849,766 and 5,083,135. For example, the second antenna element 36 may cover less surface area of the transparency 10 than the first antenna element 34. In one particular non-limiting embodiment for a windshield, the second antenna element 36 can have a length of 50 inches to 65 inches and a width of 1 inch to 4 inches and the first antenna element 34 can have a length of 50 inches to 65 inches and a width of 30 inches to 45 inches.

A first connector 40 can be electrically connected to the first antenna element 34 and a second connector 42 can be electrically connected to the second antenna element 36 in conventional manner. For example, each connector 40, 42 can be connected to the respective antenna elements 34, 36 by an adhesive. The connectors 40, 42 can be fabricated from a flat metal sheet such as stainless steel, copper, tin or any other electroconductive material. If required, combinations of materials such as stainless steel coated with copper, tin or silver may be used to enhance conductivity and strength. In addition, the connectors may also be formed from a metal mesh or electroconductive plastic. For example, the connectors 40, 42 may be 60 mm by 2.5 mm copper strips. Any conventional connectors may be used in the practice of the invention. As an alternative to such direct connectors, a capacitive coupling system can be used. One example of such a capacitive coupling is described in U.S. Pat. No. 5,355,144 which is herein incorporated by reference.

In the practice of the invention, the first and second antenna elements 34, 36 are not directly electrically interconnected. Further, in accordance with the present invention and as shown in FIG. 1, the first antenna element 34 is electrically connected to an electronic ground 54 through an electronic filtering device 56 including a filtering element, such as but not limited to a low-pass filter, bandpass filter, or inductor. For example, the ground 54 can be a conventional chassis ground in which the signal is directed to the vehicle body. The filter device 56 is sized, i.e. for inductors the value of inductance is chosen, such that the inductor passes one or more selected frequencies, e.g., one or more frequencies in the range of 510 kHz to 1710 kHz, such as 530 kHz to 1710 kHz (AM frequencies), to the ground 54 but not frequencies outside the selected frequencies, e.g., FM, UHF, VHF, frequencies. In other words, the inductor presents a low impedance at one or more selected frequencies in the range of 150 kHz to 1710 kHz to shunt these selected frequencies to the ground 54 but presents a high impedance for frequencies outside of the selected frequencies. The inductor acts like a "short" at the selected frequencies but acts like an "open" at frequencies outside the selected frequencies. Thus, the selected frequencies, e.g., AM frequencies, are effectively "filtered out" of the signal from the first antenna element 34 and are not passed to a transmitting or receiving device. Suitable inductors for the practice of the invention are commercially available from many suppliers, such as the Hirschmann Co. of Germany. For example but not to be considered as limiting, inductors having an inductance of 1 nano-henry to 50 micro-henries, such as 10 nano-henries to 10 micro-henries, can be used. As will be appreciated by one skilled in the art, the particular inductor(s) selected will be determined by the selected frequencies desired to be filtered out or grounded out of the signal from the first antenna element 34.

The first and/or second antenna elements 34, 36 also may be connected directly to one or more transmitting or receiving devices 50, such as an AM/FM radio, television, commercial broadcast radio, global positioning (GPS) receiver, and the like. Alternatively, in the embodiment shown in FIG. 1, the first and/or second connectors 40, 42 may be electrically connected to one or more optional electronics modules 46 in any convenient manner, e.g., by wires or cables. The electronics module 46 may be electrically connected to one or more of the transmitting or receiving devices 50 in any conventional manner, such as by one or more transmission lines, wires or cables.

The optional electronics module 46 can and preferably does provide signal conditioning and/or amplification to the signals received from the first and second antenna elements 34, 36. For example, the electronics module 46 can include one or more amplifiers to increase antenna gain. Additionally, the electronics module 46 can provide impedance matching between the antenna 12 and the transmission line(s) leading to the receiver. Matching or balancing the impedance between the antenna 12 and the transmission line(s) improves power transfer from the antenna to the receiver. Such electronics modules 46 are well known to one of ordinary skill in the art and, hence, will not be discussed in detail. The filter device 56 may be located in the electronics module 46, may be separate from the electronics module 46, or may be located on the transparency 10, e.g., on one of the plies.

Additionally, signals received by the first and second antenna elements 34 and 36 may be directed or received by one or more transmitting or receiving devices 50. Further, selected portions of the signals from the first and second antenna elements 34, 36 may be directed to or used by one or more of the devices 50.

The first antenna element 34 is preferably positioned closer to the source of electronic noise, e.g., below the second antenna element 36 on or in the support (e.g., transparency or ply 10, 14) to shield the second antenna element 36 from at least a portion of noise, e.g., low frequency or AM noise generated from sources in or around the engine compartment and dashboard of the vehicle. Signals of the selected frequencies received by the first antenna element 34 are "filtered out" by the filter device 56, e.g., an inductor, and are not forwarded to the device 50, e.g., a radio. Rather, the second antenna element 36, spaced farthest away from and affected least by the vehicle AM noise sources, can provide the one or more selected frequencies filtered from the first antenna element 34 either alone or in addition to other frequencies received by the second antenna element 36 to the receiver. Thus, the second antenna element 36 is designed to provide a signal which includes one or more of the selected frequencies filtered from the signal provided by the first antenna element 34. This antenna structure helps improve the quality of the overall signal reception, particularly the AM signal reception, of the device 50.

Although not required, either one or both of the antenna elements 34, 36 may also function as a heater or defroster. For example, as shown in FIG. 1, two or more bus bars 60 may be positioned in electrical contact with at least one of the antenna elements 34, 36, e.g., the first antenna element 34. The bus bars 60 can be formed from a silver-containing ceramic material. The bus bars 60 are electrically connected to a power source 62, such as a 12 volt (V), 24 V, or 42 V vehicle battery, in conventional manner, such as by wires. If desired, an opaque border, such as ceramic material, may be applied to the windshield to conceal the bus bars 60 and wires.

An alternative heating system 64 is schematically shown by dashed lines in FIG. 2. Rather than having bus bars 60 in contact with the first antenna element 34, the alternative heating system 64 is formed by one or more heater elements 66 located on one or more of the surfaces, e.g., one or more of the inner surface 26, and connected to the power source 62, e.g., by one or more other bus bars (not shown). The heater elements 66 can be formed by a plurality of conductive films or, for non-windshield use, by a plurality of metal strips or wires, or in any other conventional manner.

Figure 3:
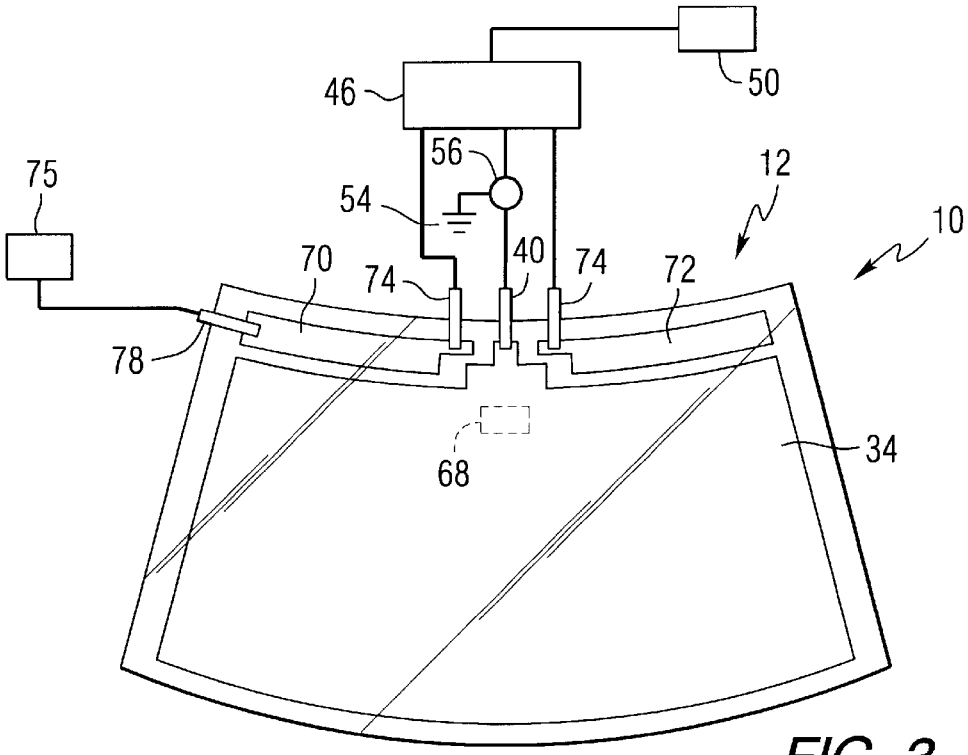
FIG. 3 is a plan view (not to scale) of a vehicle transparency having another antenna incorporating features of the invention.

FIG. 3 shows an alternative embodiment of the invention in which the second antenna element 36 is divided into a plurality, e.g., two, non-electrically interconnected second antenna portions 70, 72. Each antenna portion 70, 72 is electrically connected to the electronics module 46 through a connector 74 similar to the connectors 40, 42 described above. Again, the first antenna element 34 is connected to the device 50 through an electronic filter device 56, such as an inductor, which passes one or more selected frequencies, e.g., one or more AM frequencies in the range of 510 kHz to 1710 kHz, to the ground 54 to eliminate the selected frequencies from the signal passed to the device 50. As described above, rather than direct electrical connection, one or more of the first antenna element 34 and/or the antenna portions 70, 72 can be coupled to the electronics module 46 by a capacitive connection. FIGS. 1 and 3 also show a deleted area 68 in the first antenna element 34. Such a deleted area 68 of any configuration known in the art allows signals to pass through the coating of the first antenna element 34, e.g., such as for signals for toll collections on highways or for signals to open and close garage doors, and the like. This deleted area 68 could alternatively be formed in the second antenna element 36.

As also shown in FIG. 3, the first and/or second antenna elements 34, 36 can be connected to more than one transmitting and/or receiving device. Further, if the signal provided by the antenna element 34 and/or 36 has acceptable gain and impedance characteristics for a particular transmitting and/or receiving device, the antenna element 34, 36 can be connected directly to the device rather than being directed through an electronics module 46. For example, FIG. 3 shows a receiving device 75, such as a cell phone, television, etc., directly connected to the antenna portion 70 by a connector 78. However, if required, an electronics module 46 can be provided between the connector 78 and the device 75 to condition or amplify the signal provided by the antenna portion 70. In similar manner, one or more additional other transmitting or receiving devices may also be connected to the first antenna element 34 by one or more other connectors positioned at different locations around the first antenna element 34.

Figure 4:
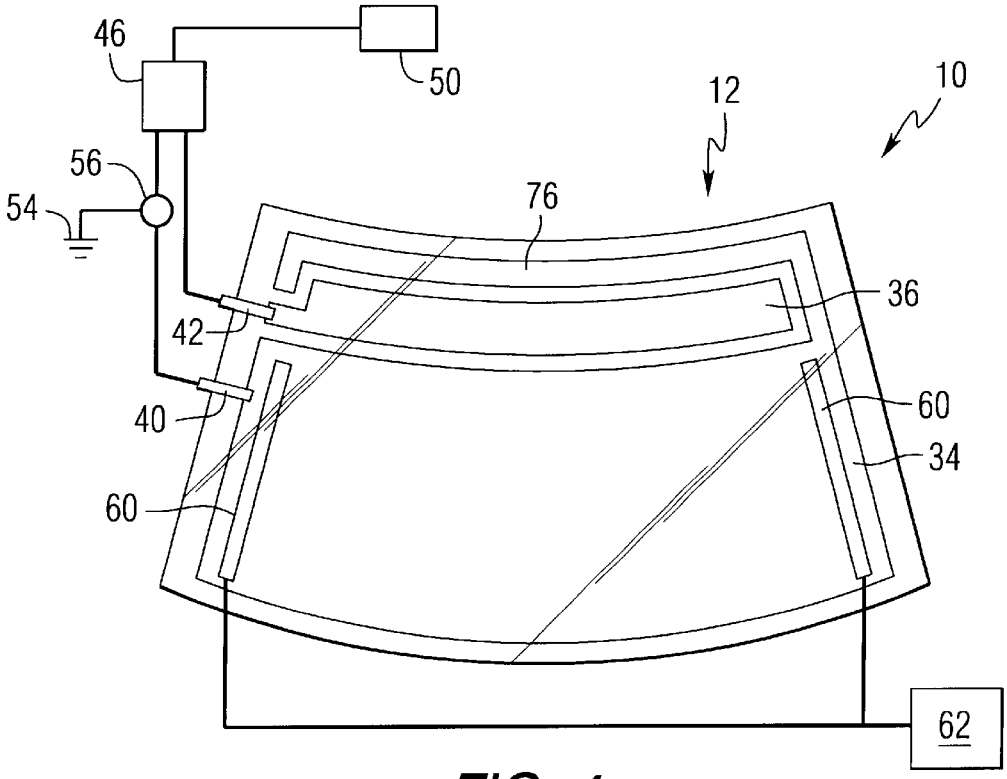
FIG. 4 is a plan view (not to scale) of a vehicle transparency having a further antenna incorporating features of the invention.

Another antenna incorporating features of the invention is shown in FIG. 4. In this embodiment, the first antenna element 34 includes an extended portion 76 extending above the second antenna element 34. If the first antenna element 34 is heated as described above with respect to the embodiment shown in FIG. 1, the extended portion 76 can help prevent ice or snow build-up in the area of the second antenna element 36 which could adversely affect signal reception by the second antenna element 36. Although in FIG. 4 the extended portion 76 is connected to the first antenna element 34, the extended portion 76 could also be a separate conductive element (i.e., not electrically connected to the first antenna element 34), such as a separate conductive coating, metal wire, ceramic, or other conductive material. When electrically separate from the first antenna element 34, the extended portion 76 can be connected to a power source 62 in any conventional manner, such as by bus bars 60, such that the extended portion 76 can be heated separately from the first antenna portion 34.

In an exemplary method of fabricating the antenna 12 shown in FIG. 1, a transparent, electroconductive coating may be applied to a support or substrate, e.g., a glass ply, in any conventional manner, such as CVD, MSVD, spray pyrolysis, sol-gel, and the like. For laminated articles, the coating can be applied to a major surface of the ply which will be an inner surface, i.e. a surface located between the plies, when the ply is laminated to form the laminated article, such as a vehicle windshield. The ply may be masked during coating to provide the desired coating patterns. For example, for the particular embodiment shown in FIG. 1, two distinct antenna elements 34, 36 are formed by applying the coating to first and second electroconductive coating regions, respectively, while masking the remainder of the ply. Alternatively, the entire surface of the ply may be coated and, thereafter, selected portions of the coating may be removed or deleted, such as by abrasive wheels, lasers, etc., to provide the desired antenna patterns. After the coatings are applied to the ply, the ply may be heated to its heat softening temperature and shaped by techniques well known in the art, e.g., press bending. As an alternative, after the coating is applied, the ply may be combined with another ply and the two plies may be shaped simultaneously by techniques well known in the art, e.g., gravity sag bending. If desired, the ply may be shaped prior to applying the antenna element coating(s). The connectors 40, 42 may then be secured in place along the surface of the ply and the plies combined with the interlayer 30. The assembly may then be laminated in any manner well known in the art to form a unitary structure. It should be appreciated that if the connectors 40, 42 are attached to the exterior of the windshield, it is not necessary to secure them in place until after lamination. The windshield may then be placed in a vehicle and the antenna 12 connected through an electronic filter device 56 to an electronic transmitting or receiving device 50, such as a radio, television, or the like, in conventional manner. When used in a vehicle transparency, the present invention provides not only a useful antenna structure but also allows for a vision area in the transparency on which it is provided.

As an alternative to positioning the antenna elements 34 and 36 directly on one of the glass plies, the elements may be formed on or within the plastic interlayer 30 of a laminated article, such as a windshield.

It should be appreciated that although the embodiments of the invention discussed above disclose an antenna 12 incorporated within a laminated article, the antenna 12 of the present invention is not limited to use with laminated articles. For example, the antenna 12 could be used on a "monolithic" article. By "monolithic" is meant an article having a single structural substrate or primary ply, e.g., a glass ply. By "primary ply" is meant a primary support or structural member. The primary ply is not limiting to the invention and may be of any desired material, such as those described above for the first and second plies 14, 22. For example, the primary ply may be a glass pane of an architectural window, a skylight, or one pane of an insulating glass unit, just to name a few.

Although in the exemplary embodiments discussed above the first antenna element 34 is connected to only one device 50 through one filter device 56 and one electronics module 46, it will be appreciated that two or more filter devices 56 and/or electronics modules 46 can be connected to the first antenna element 34 to supply signals to multiple transmitting or receiving devices 50, with each of the filter devices 56 configured to filter out one or more frequencies of any desired wavelength. Additionally, although in the exemplary embodiments described above only one first antenna element 34 is discussed, it will be appreciated that the first antenna element 34 can be formed by two or more separate, i.e. not electrically connected, electroconductive coating regions. Each coating region could be connected to a separate filter device 56 to filter out a different frequency or range of frequencies provided to a transmitting or receiving device.

It will be readily appreciated by one of ordinary skill in the art that modifications may be made to the invention without departing from the concepts disclosed in the foregoing description. For example, although the foregoing description was directed primarily to eliminating AM frequency noise to a receiving device, the invention could be used to reduce or eliminate noise or interference of any desired frequency depending upon the type of filter device used in the practice of the invention. Accordingly, the particular embodiments described in detail herein are illustrative only and are not limiting to the scope of the invention, which is to be given the full breadth of the appended claims and any and all equivalents thereof.

What is claimed is:

1. An antenna, comprising:

a support;

at least one electroconductive first antenna element located on the support;

at least one electroconductive second antenna element located on the support and spaced from the first antenna element; and at least one electronic filter device, wherein the first antenna element is electrically connected to the electronic filter device such that one or more selected frequencies from the first antenna element are passed to a ground by the filter device and wherein the second antenna element is configured to provide at least one of the selected frequencies passed to the ground from the first antenna element.

2. The antenna according to claim 1, wherein the support is a monolithic article.

3. The antenna according to claim 1, wherein the support is a laminated article.

4. The antenna according to claim 3, wherein the laminated article includes a plurality of major surfaces and the first and second antenna elements are located on the same major surface.

5. The antenna according to claim 3, wherein the laminated article includes a plurality of major surfaces and the first and second antenna elements are located on different major surfaces.

6. The antenna according to claim 3, wherein the article has a first ply spaced from a second ply.

7. The antenna according to claim 6, wherein the first and second plies include inner and outer major surfaces and the first and second antenna elements are located on at least one of the inner surfaces.

8. The antenna according to claim 3, wherein the laminated article is an automotive windshield.

9. The antenna according to claim 1, wherein the support is substantially transparent.

10. The antenna according to claim 1, wherein the support is glass.

11. The antenna according to claim 1, wherein the first antenna element comprises at least one electroconductive coating.

12. The antenna according to claim 11, wherein the electroconductive coating is at least substantially transparent.

13. The antenna according to claim 1, wherein the second antenna element comprises at least one electroconductive coating.

14. The antenna according to claim 1, wherein the second antenna element comprises at least one metal or wire antenna element.

15. The antenna according to claim 1, wherein the electronic filter device includes an inductor.

16. The antenna according to claim 15, wherein the inductor has an inductance in the range of 1 nano-henry to 50 micro-henries.

17. The antenna according to claim 1, wherein the selected frequencies are in the range of 150 kHz to 1710 kHz.

18. The antenna according to claim 1, including at least one receiver electrically connected to the first and second antenna elements.

19. The antenna according to claim 1, wherein the first antenna element is electrically connected to an electrical power source.

20. The antenna according to claim 1, including at least one heater element located on the support.

21. A vehicle transparency, comprising:

a first ply having an inner surface and an outer surface;

a second ply having an inner surface and an outer surface, wherein the first and second plies are bonded together by an interlayer to form a transparency having a top and a bottom;

at least one first antenna element located on at least one of the inner surfaces;

at least one second antenna element located on at least one of the inner surfaces and spaced apart from the first antenna element, wherein at least a portion of the first antenna element is located in the transparency between the second antenna element and a source of electronic noise to shield the second antenna element from the electronic noise of one or more selected frequencies; and an electronic filter device, wherein the first antenna element is electrically connected to the filter device, and wherein the electronic filter device is configured to pass one or more selected frequencies from the first antenna element to a ground and wherein the second antenna element is configured to provide at least one of the selected frequencies passed to the ground from the first antenna element.

22. The vehicle transparency according to claim 21, including two or more bus bars electrically connected to the first antenna element and a power source.

23. The vehicle transparency according to claim 21, including at least one heater element located on at least one of the surfaces and connected to a power source.

24. The vehicle transparency according to claim 21, wherein the electronic filter device includes an inductor having an inductance of 1 nano-henry to 50 micro-henries.

25. The vehicle transparency according to claim 21, wherein the filter device is configured to pass one or more selected frequencies in the range of 510 kHz to 1710 kHz to the ground.

26. The vehicle transparency according to claim 21, wherein the second antenna element is configured to provide at least one of the selected frequencies passed to the ground from the first antenna element.

27. The vehicle transparency according to claim 21, wherein the first antenna element is located below the second antenna element in the transparency.

28. A method of making an antenna, comprising the steps of:

providing at least one electroconductive first coating region on a support;

providing at least one electroconductive second coating region on the support and spaced from the first coating region; and electrically connecting the first coating region to an electronic filter device, wherein the electronic filter device is configured to pass one or more selected frequencies from a signal provided by the first coating region to a ground and wherein the second coating region is configured to provide at least one of the selected frequencies passed to the ground from the first coating region.

29. The method according to claim 28, wherein the electronic filter device is configured to pass one or more frequencies in the range 510 kHz to 1710 kHz to the ground.

30. The method according to claim 28, wherein the support is an automotive windshield having a top and a bottom and the method includes positioning at least a portion of the first coating region between the second coating region and the bottom of the windshield such that the first coating region shields the second coating region from electronic noise of one or more of the selected frequencies.

31. A method of reducing electronic interference of one or more selected frequencies in an antenna signal, comprising the steps of:

providing at least one electroconductive first antenna element on a support;

providing at least one electroconductive second antenna element on the support, with the first antenna element positioned between the second antenna element and a source of electronic noise of one or more selected frequencies;

connecting the first and second antenna elements to a transmitting or receiving device; and electrically connecting the first antenna element to an electronic filter device configured to pass one or more of the selected frequencies of the electronic noise to a ground to eliminate the one or more selected frequencies from a signal provided by the first antenna element such that the one or more selected frequencies are provided to the device by the at least one second antenna element.

* * * * *